US009662705B2

(12) United States Patent
Otsubo et al.

(10) Patent No.: US 9,662,705 B2
(45) Date of Patent: May 30, 2017

(54) PROCESSING MACHINE AND BENDING METHOD

(71) Applicant: DENSO CORPORATION, Kariya, Aichi-pref. (JP)

(72) Inventors: Hidemasa Otsubo, Obu (JP); Masafumi Torimoto, Toyota (JP); Kazuhiro Mitsukawa, Ichinomiya (JP); Masahito Sugiura, Hekinan (JP); Takao Ikeda, Okazaki (JP)

(73) Assignee: DENSO CORPORATION, Kariya (JP)

( * ) Notice: Subject to any disclaimer, the term of this patent is extended or adjusted under 35 U.S.C. 154(b) by 132 days.

(21) Appl. No.: 14/573,138

(22) Filed: Dec. 17, 2014

(65) Prior Publication Data

US 2015/0174641 A1 Jun. 25, 2015

(30) Foreign Application Priority Data

Dec. 25, 2013 (JP) ..... 2013-266765

(51) Int. Cl.
*B21J 5/12* (2006.01)
*B21J 13/02* (2006.01)
(Continued)

(52) U.S. Cl.
CPC ..... *B21J 5/12* (2013.01); *B21D 13/02* (2013.01); *B21J 13/02* (2013.01); *B30B 1/261* (2013.01)

(58) Field of Classification Search
CPC ..... B21J 5/12; B21J 9/022; B21J 9/10; B21J 9/18; B21J 13/02; B21J 13/025;
(Continued)

(56) References Cited

U.S. PATENT DOCUMENTS

2006/0193939 A1 8/2006 Ohtsuka et al.
2008/0314111 A1* 12/2008 Takemoto ..... B21D 39/021 72/323

FOREIGN PATENT DOCUMENTS

JP A-H06-210360 8/1994
JP 2000-271650 A 10/2000
(Continued)

OTHER PUBLICATIONS

Machine translation of Description section of JP 2004058147 provided by EPO website (espacenet.org).*
(Continued)

*Primary Examiner* — Peter DungBa Vo
*Assistant Examiner* — Joshua D Anderson
(74) *Attorney, Agent, or Firm* — Oliff PLC

(57) ABSTRACT

A processing machine for performing a bending operation on a workpiece includes a die, a punch movable in a first direction for pressing the workpiece against the die, a slide member movable in a second direction perpendicular to the first direction, a first cam device that moves the punch toward the die for deforming the workpiece when being actuated by movement of the slide member, a second cam device that moves the punch for pressing a surface of the workpiece when being actuated by movement of the slide member. The pressure angle of the second cam device is smaller than a pressure angle of the first cam device. The processing machine further includes a drive member configured to move the slide member such that the second cam device is actuated after the first cam device is actuated.

1 Claim, 10 Drawing Sheets

(51) Int. Cl.
*B21D 13/02* (2006.01)
*B30B 1/26* (2006.01)

(58) Field of Classification Search
CPC . B21D 5/01; B21D 5/02; B21D 13/00; B21D 13/02; B30B 1/26; B30B 1/261; B30B 1/40
USPC ..... 72/373–376, 379.6, 385, 390.3, 403, 72/452.1, 452.8, 452.9
See application file for complete search history.

(56) References Cited

FOREIGN PATENT DOCUMENTS

| | | | |
|---|---|---|---|
| JP | 2004-058147 | A | 2/2004 |
| JP | 2005-205430 | A | 8/2005 |
| JP | A-2006-136896 | | 6/2006 |
| JP | A-2006-263815 | | 10/2006 |

OTHER PUBLICATIONS

Jan. 14, 2016 Office Action issued in Japanese Patent Application No. 2013-266765.

* cited by examiner

PROCESSING MACHINE AND BENDING METHOD

This application claims priority to Japanese Patent Application No. 2013-266765 filed on Dec. 25, 2013, the entire contents of which are hereby incorporated by reference.

BACKGROUND OF THE INVENTION

1. Field of the Invention

The present invention relates to a processing machine for performing a bending operation and a bending method.

2. Description of Related Art

There is known a processing machine for performing a bending operation on a plate-like workpiece by placing the workpiece on a die and pressing a punch against the workpiece. Japanese Patent Application Laid-open No. 2006-263815 describes such a processing machine. This processing machine is configured such that a pressure cam block disposed slidably on inclined surfaces of punches located on the side opposite to a die is moved in parallel to the die for moving the punches toward the die to thereby bend a workpiece. The punches are pressed against the workpiece successively in the order from the one whose inclined surface is the closest to the starting point of the pressure cam block so that the workpiece is formed in a corrugated shape having bumps and dents.

In the processing machine described above, the punches are pressed against the workpiece successively when the pressure cam block moves from the starting point to an end point at a load depending on the pressure angle of the inclined surfaces. Accordingly, if the pressure angle is excessively large, it may occur that the plastic deformation of the workpiece is insufficient, and the workpiece slightly returns its original shape. In this case, the shape accuracy of the corner R portions and the shape accuracy of the flat portions at the crests of the bumps and the valleys of the dents of the workpiece formed in a corrugated shape may be degraded. Incidentally, if the pressure angle of the inclined surfaces of the punches is reduced for increasing the load applied from the punches to the workpiece, the size of the processing machine increases because the travel distance of the pressure cam block increases.

SUMMARY

An exemplary embodiment provides a processing machine for performing a bending operation on a workpiece including:

a die on which the workpiece is placed;

a punch movable in a first direction for pressing the workpiece against the die;

a slide member movable in a second direction perpendicular to the first direction;

a first cam device that moves the punch toward the die for deforming the workpiece when being actuated by movement of the slide member;

a second cam device that moves the punch for pressing a surface of the workpiece when being actuated by movement of the slide member, a pressure angle of the second cam device being smaller than a pressure angle of the first cam device; and a drive member configured to move the slide member such that the second cam device is actuated after the first cam device is actuated.

The exemplary embodiment also provides a bending method for performing a bending operation using the processing machine, including:

a positioning process of positioning the workpiece on the die;

a bending process of deforming the workpiece by moving the slide member using the drive member to actuate the first cam device to cause the punch to press the workpiece at a first load; and a surface pressing process of pressing a surface of the deformed workpiece by moving the slide member using the drive member to actuate the second cam device to cause the punch to press the surface of the workpiece at a second load larger than the first load.

According to the exemplary embodiment, there are provided a processing machine and a bending method capable of performing a bending operation on a workpiece with high degree of accuracy.

Other advantages and features of the invention will become apparent from the following description including the drawings and claims.

PREFERRED EMBODIMENTS OF THE INVENTION

First Embodiment

Figure 1:
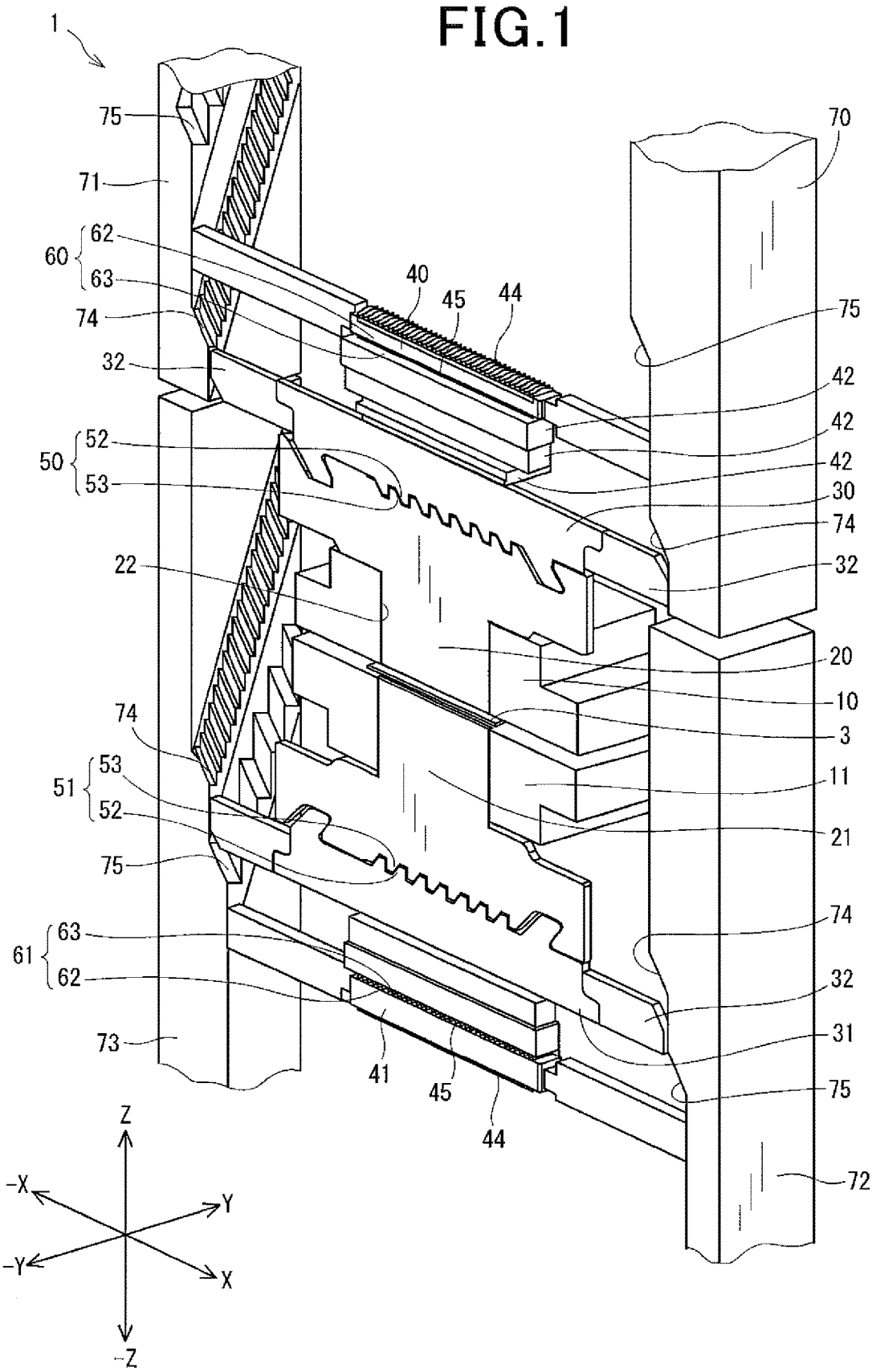
FIG. 1 is a diagram showing the structure of a processing machine according to a first embodiment of the invention.

A processing machine 1 according to a first embodiment of the invention is described with reference to FIGS. 1 to 7. The processing machine 1 is for performing a bending process and a surface pressing process on a workpiece 3 such as a metal plate such that the workpiece is formed in a shape having bumps and dents. The work piece 3 processed by the processing machine 1 can be used as a corrugated fin, for example. In the below description made using an X direction, a Y direction and a Z direction orthogonal to one another as shown in FIG. 1, the upward direction corresponds to the Z direction, and downward direction corresponds to the −Z direction. However, they do not define the actual mounting direction of the processing machine 1.

As shown in FIG. 1, the workpiece 3 is placed between an upper die 10 and a lower die 11 of the processing machine 1. The processing machine 1 includes, on the Z side (the side of the Z direction), the die 10, a punch 20, a first slide member 30, a second slide member 40, a first cam device 50 and a second cam devices 60, and includes, on the −Z side (the side of the −Z direction), a punch 21, a first slide member 31, a second slide member 41, a first cam device 51 and a second cam devices 61. The processing machine 1 further includes four slide columns 70, 71, 72 and 73 for driving the first slide members 30 and 31, and the second slide members 40 and 41. The die 10, punch 20, first slide member 30, second slide member 40, first cam device 50, second cam device 60 and slide columns 70 and 71 are processing components disposed upward of the workpiece 3. The die 11, punch 21, first slide member 31, second slide member 41, first cam device 51, second cam device 61 and slide columns 72 and 73 are processing components disposed downward of the workpiece 3. Since the processing components disposed upward of the workpiece 3 are substantially the same as the processing components disposed downward of the workpiece 3, only the processing components disposed upward of the workpiece 3 are explained below.

The punch 20 is inserted in an insertion hole 22 formed inside the die 10 so as to be slidable vertically. The punch 20 presses the workpiece 3 downward against the die 11 at its end surface on the side of the workpiece 3. The processing machine 1 includes a plurality of the punches arranged in the Y direction. However, FIG. 1 shows only the two punches 20 and 21 disposed respectively on the Z side and −Z side across the workpiece 3, and the other punches arranged in the Y direction are omitted from the illustration. This also applies to each of the first slide members, second slide members, first cam devices and second cam devices. In this embodiment, the thickness in the Y direction of each of the punches 20 and 21, the first slide members 30 and 31, the second slide members 40 and 41, and the first cam devices 50 and 51 is approximately 2 mm.

Figure 2:
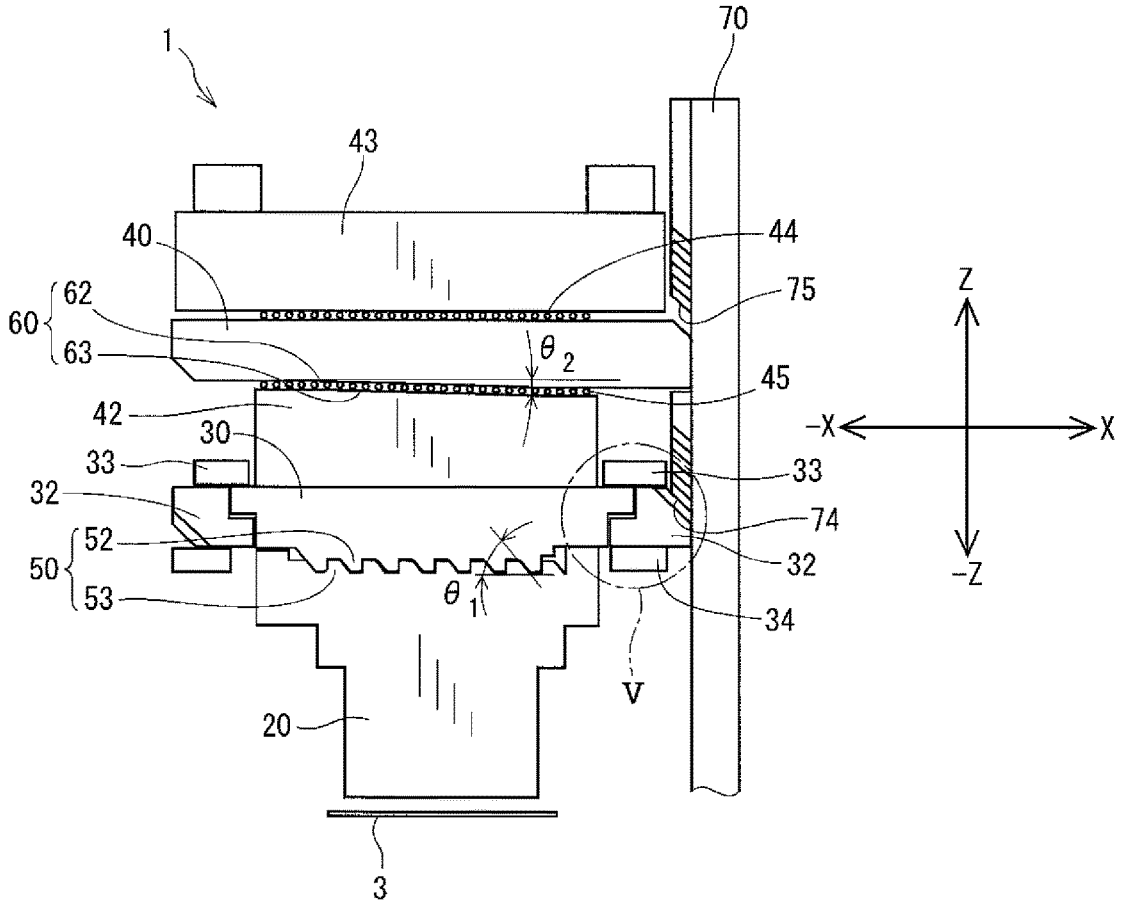
FIGS. 2 to 4 are diagrams for explaining the operation of the processing machine according to the first embodiment of the invention.
Figure 3:
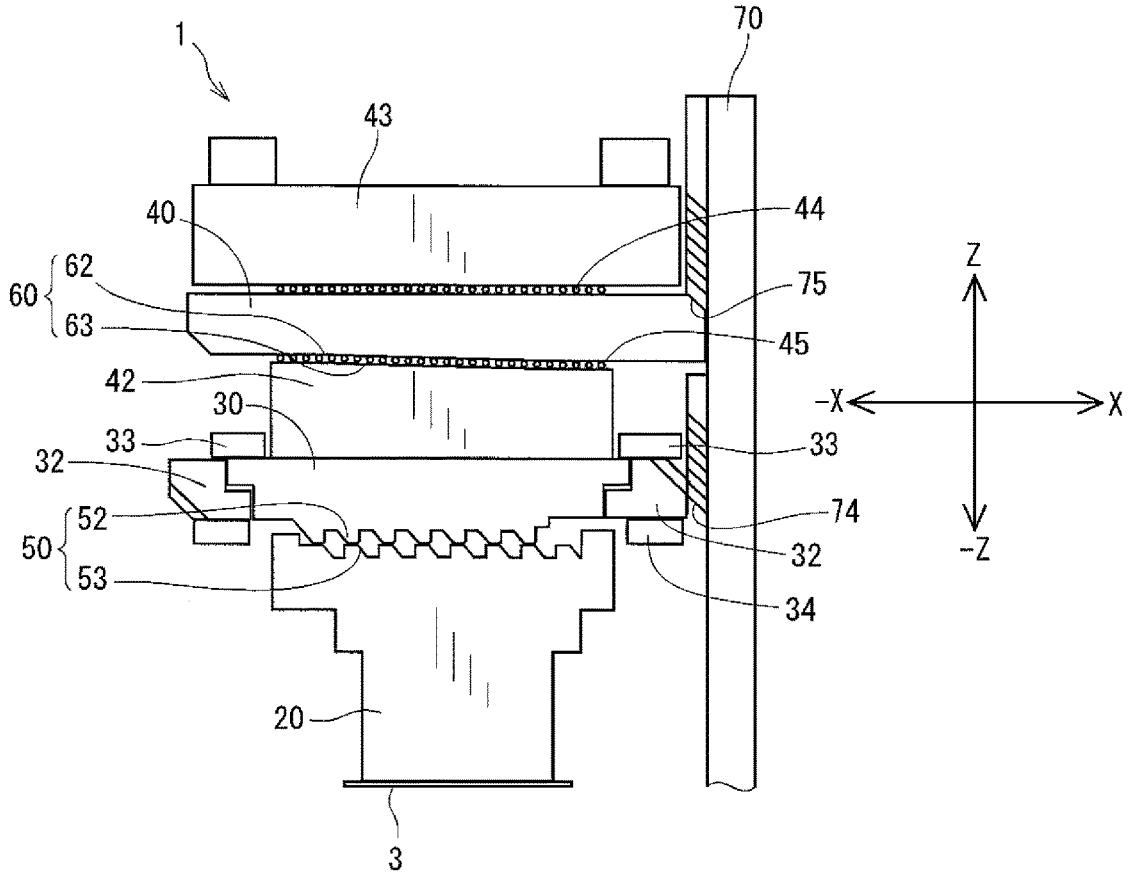
Figure 4:
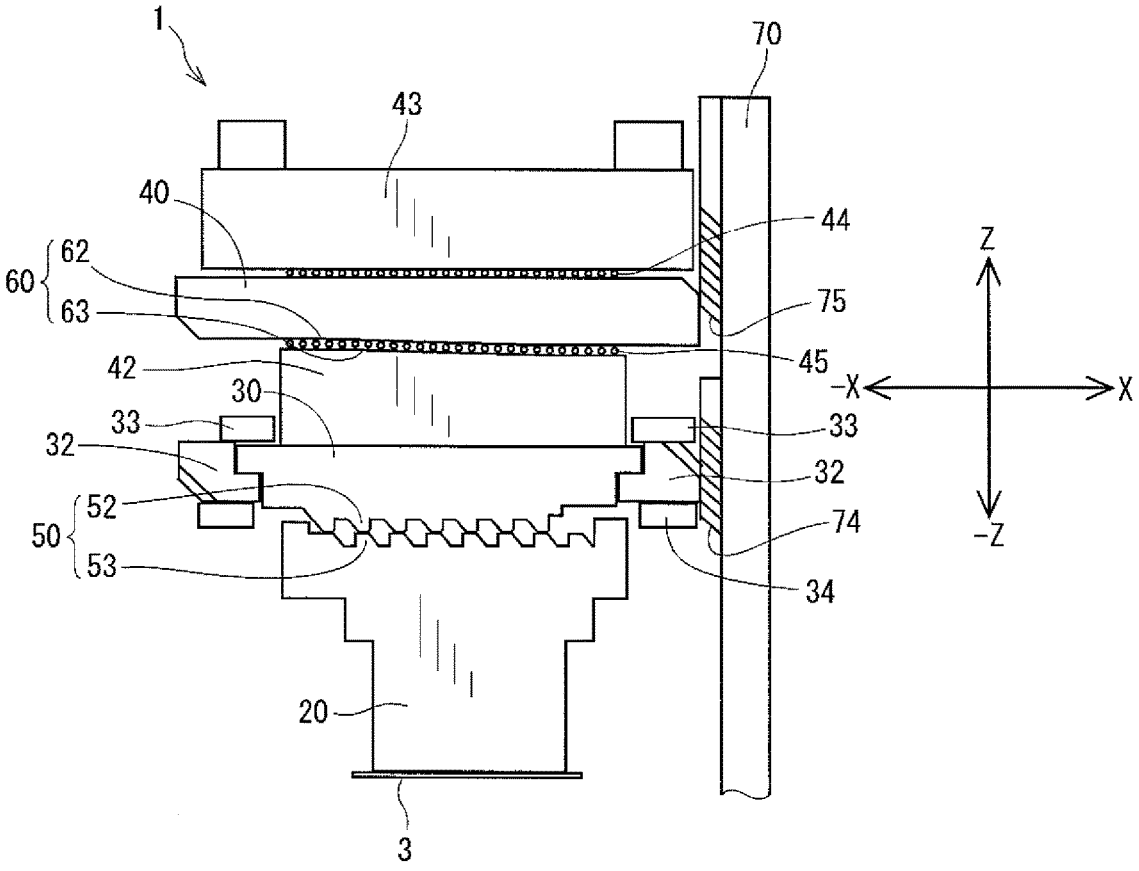
Figure 5:
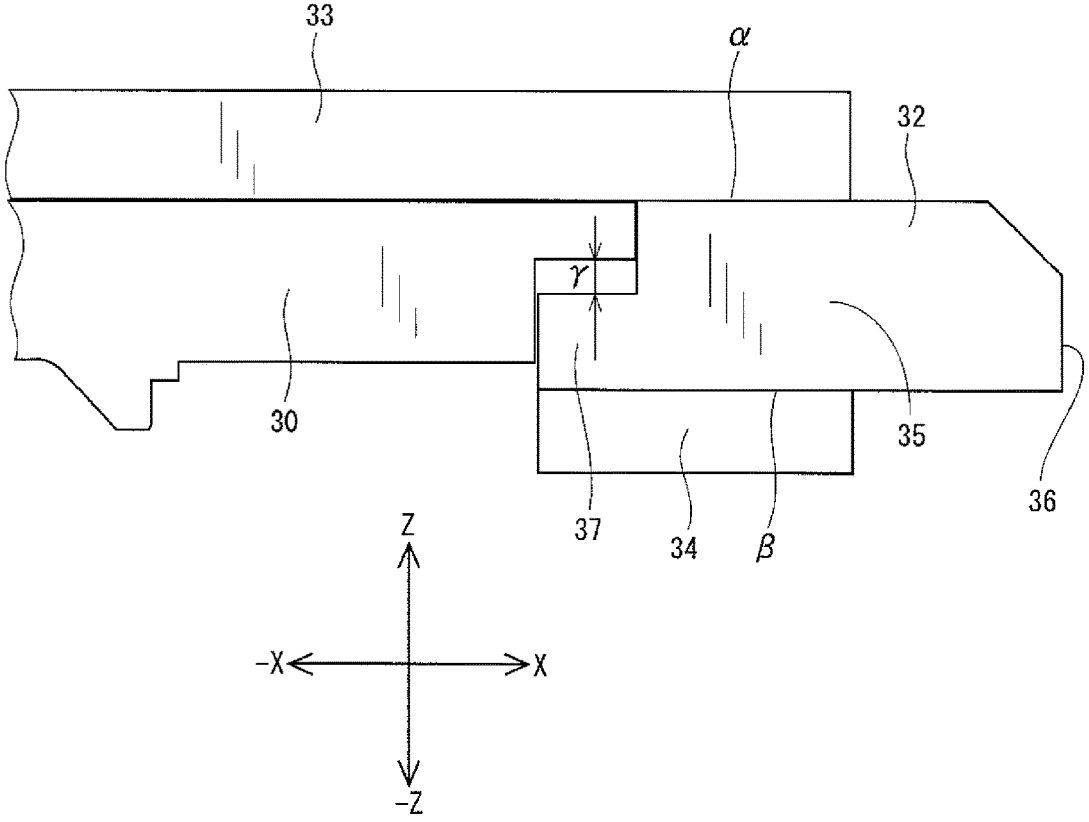
FIG. 5 is an enlarged view of the part V of FIG. 2.
Figure 6:
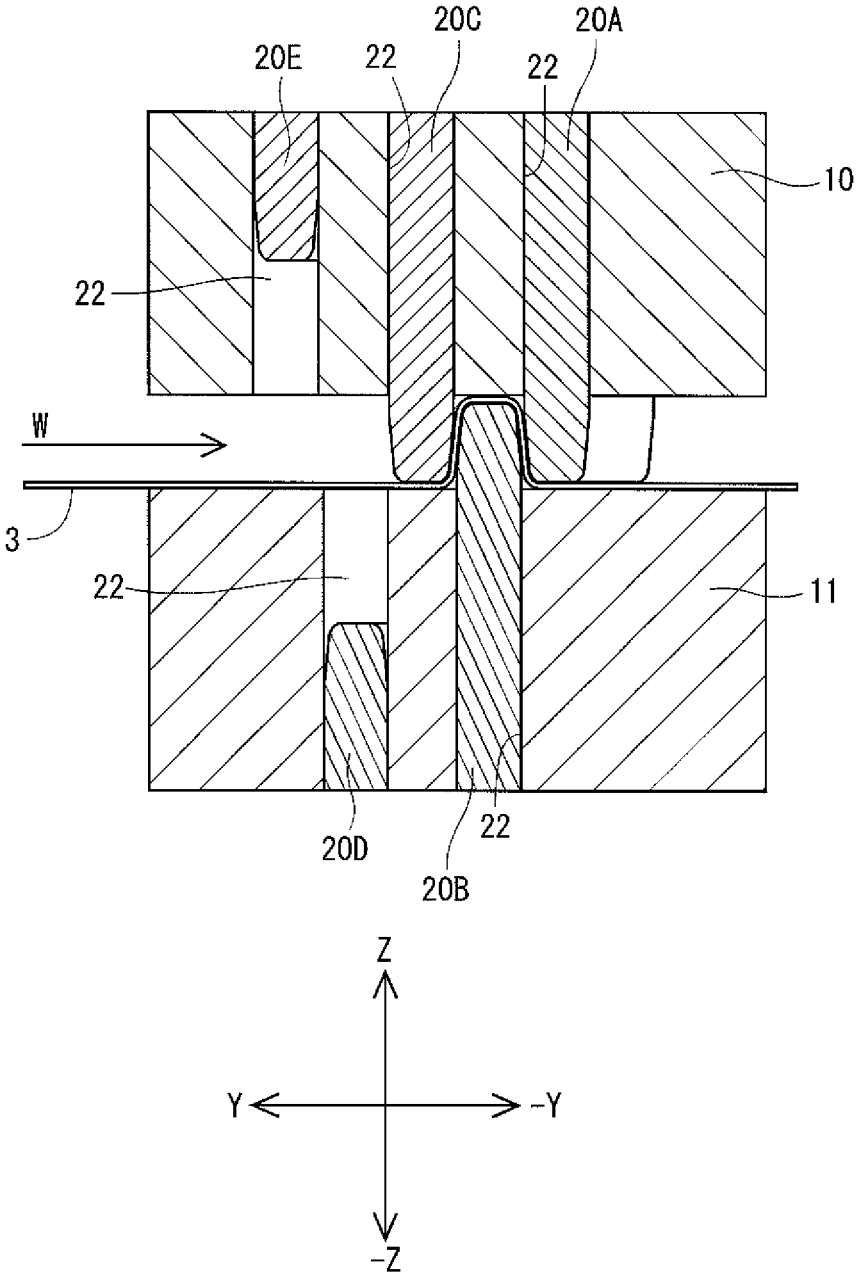
FIG. 6 is a diagram for explaining the operation of punches of the processing machine according to the first embodiment of the invention.

The first slide member 30 is disposed upward of the punch 20 and supported by hanger members 32 at its both ends. As shown in FIGS. 2 and 5, the hanger members 32 are restricted from moving to the opposite die side by first restriction members 33 and from moving to the die side by second restriction members 34. Accordingly, the first slide member 30 and the hanger members 32 are both movable in the X direction and in the −X direction. In FIGS. 2 to 4, the processing components disposed downward of the workpiece 3, the die 10 and the left side slide columns 70 and 71 are omitted from illustration. As shown in FIG. 5, the hanger member 32 includes a hanger body 35, a sliding part 36 which is in slide contact with the slide columns 70 or 71, and a support part 37 disposed on the die side of the first slide member 30. The support part 37 restricts the first slide member 30 from moving to the die side. Each of a gap alpha between the hanger member 32 and the first restriction member 33 and a gap beta between the hanger member 32 and the second restriction member 34 is set to a value which is sufficiently small to enable the hanger member 32 to move in the X direction and in the −X direction and to suppress the inclination of the hanger member 32. A gap gamma is present between the support part 37 of the hanger member 32 and the first slide member 30 when the first slide member 30 and the first restriction member 33 are in abutment with each other. This gap gamma is a space necessary for the first slide member 30 to move to the die side by the action of the second cam device 60.

As shown in FIG. 2, the first cam device 50 is disposed between the first slide member 30 and the punch 20. The first cam device 50 includes a first slide member side cam 52 disposed on the die side of the first slide member 30, and a punch side cam 53 disposed on the opposite die side of the punch 20. When the first slide member side cam 52 moves in the −X direction together with the first slide member 30, the punch side cam 53 and the punch 20 move in the −Z direction. The pressure angle θ1 of the first cam device 50 is set to a value which enables producing a load necessary for performing the bending step on the workpiece 3. In this embodiment, the pressure angle θ1 is set to 45 degrees, for example. Therefore, the first cam device 50 can move the punch 20 to the die side in interlock with the movement of the first slide member 30 to deform the workpiece 3.

The second slide member 40 is on the opposite punch side of the first slide member 30 across a pressing member 42. The pressing member 42 restricts the second slide member 40 from moving to the die side. A fixing member 43 restricts the second slide member 40 from moving to the opposite die side. The second slide member 40 can move in the X direction and in the −X direction. In this embodiment, the width in the Y direction of the pressing member 42 is set to a value which enables pressing the plurality of first slide members 30 at the same time.

The second cam device 60 is disposed between the second slide member 40 and the pressing member 42. The second cam device 60 includes a second slide member side cam 62 disposed on the die side of the second slide member 40, and a pressing member side cam 63 disposed on the opposite die side of the pressing member 42. When the second slide member side cam 62 moves in the −X direction together with the second slide member 40, the pressing member side cam 63 and the pressing member 42 move in the −Z direction. The pressure angle θ2 of the second cam device 60 is set to a value which enables producing a load necessary for performing the surface pressing step on the workpiece 3. The pressure angle θ2 of the second cam device 60 is smaller than the pressure angle θ1 of the first cam device 50. In this embodiment, the pressure angle θ2 is set to 5 degrees, for example. Therefore, the second cam device 60 can press the first slide member 30 and the punch 20 against the workpiece 3 in interlock with the movement of the second slide member 40.

An upper roller 44 is disposed between the second slide member 40 and the fixing member 43. A lower roller 45 is disposed between the second slide member 40 and the pressing member 42, that is, between the second slide member side cam 62 of the second cam device 60 and the pressing member side cam 63. The upper and lower rollers 44 and 45 reduce the frictional force occurring when the second slide member 40 moves in the X direction or the −X direction.

As shown in FIGS. 1 and 2, the slide columns 70 and 71 which are in slide contact with the hanger members 32 and the second slide member 40 can move in the Z direction and in the −Z direction. Each of the slide columns 70 and 71 includes a third cam device 74 and a fourth cam device 75. Each of the third cam device 74 and the fourth cam device 75 is formed of an inclined surface which is inclined in the −X direction. The third cam device 74 can move the hanger member 32 and the first slide member 30. The fourth cam device 75, which is disposed at a predetermined distance in the Z direction from the third cam device 74, can move the second slide member 40. The fourth cam device 75 is disposed at such a position as to be able to move the second slide member 40 after the third cam device 74 moves the first slide member 30.

When both the slide columns 70 and 71 located upward of the workpiece 3 move in the −Z direction at the same time, the hanger members 32 and the first slide member 30 are moved in the −X direction by the action of the third cam device 74. When both the slide columns 70 and 71 further move in the −Z direction at the same time, the second slide member 40 is moved in the −X direction by the action of the fourth cam device 75. Therefore, the slide columns 70 and 71 can actuate the second cam device 60 by moving the second slide member 40 after moving the first slide member 30 to actuate the first cam device 50. In a case where the pressing member 42 can press the plurality of the first slide members 30 at the same time, the fourth cam devices 75 are mounted on the slide columns 70 and 71 at such positions as to be able to move the second slide members 40 after the third cam devices 74 move the plurality of the first slide members 30.

Next, a bending method performed using the above described processing machine 1 is explained. This bending method includes a positioning step, a bending step and a surface pressing step. As shown in FIG. 2, in the positioning step, the workpiece 3 is placed between the upper die 10 and the lower die 11. As shown in FIG. 3, in the bending step, the slide columns 70 and 71 (the left slide column 71 being omitted from illustration) are moved in the −Z direction to move the hanger members 32 and the first slide member 30 in the −X direction, as a result of which the punch 20 is moved in the −Z direction to deform the workpiece 3. At this time, the first slide member side cam 52 of the first cam device 50 and the punch side cam 53 move from the positions at which their inclined portions are in slide contact to positions at which their flat portions are in slide contact. The flat portion of the first slide member side cam 52 and the flat portion of the punch side cam 53 are parallel to the X-direction. When the punch 20 applies a load to the workpiece 3 in the bending step, the first slide member 30 abuts against the first restriction members 33 because of the reaction force of the workpiece 3. Accordingly, as shown in FIG. 5, the gap gamma is formed between the first slide member 30 and the hanger member 32.

The plurality of the punches 20 (indicated by 20A to 20E in FIG. 6) located upward and downward of the workpiece 3 are actuated in the order of 20A, 20B, 20C, 20D and 20E. The upper punches 20A, 20C and 20E press the workpiece 3 downward against the lower die 11. The lower punches 20B and 20D press the workpiece 3 upward against the upper die 11. Accordingly, the workpiece 3 is processed while being pulled in between the punches 20A and 20B and between the punches 20B and 200 successively as shown by the arrow W.

In the surface pressing step following the bending step, as shown in FIG. 4, the slide columns 70 and 71 are further moved in the −Z direction to move the second slide member 40 in the −X direction, so that the pressing member 42, the first slide member 30, the first cam device 50 and the punch 20 are moved in the −Z direction by the actuation of the second cam device 60. At this time, the first slide member 30 moves through the gaps gamma formed between the first slide member 30 and the hanger members 32, and abuts against the support parts 37 of the hanger members 32. Since the pressure angle θ2 of the second cam device 60 is smaller than the pressure angle θ1 of the first cam device 50, the load applied to the workpiece 3 by the punch 20 in the surface pressing step is larger than that in the bending step. In this embodiment, the load applied to the workpiece 3 in the surface pressing step is approximately four times that applied in the bending step. Accordingly, the workpiece 3 is plastic-deformed and its shape is fixed. Incidentally, during the bending step, the first slide member side cam 52 of the first cam device 50 and the punch side cam 53 are in the state of their flat portions being in slide contact. Accordingly, the first slide member 30 and the hanger members 32 can be prevented from applying a load to the third cam device 74 of the slide column 70 on the side of the X direction when the second cam device 60 applies a load to the first cam device 50 through the pressing member 42 and the first slide member 30 in the surface pressing step.

Figure 7:
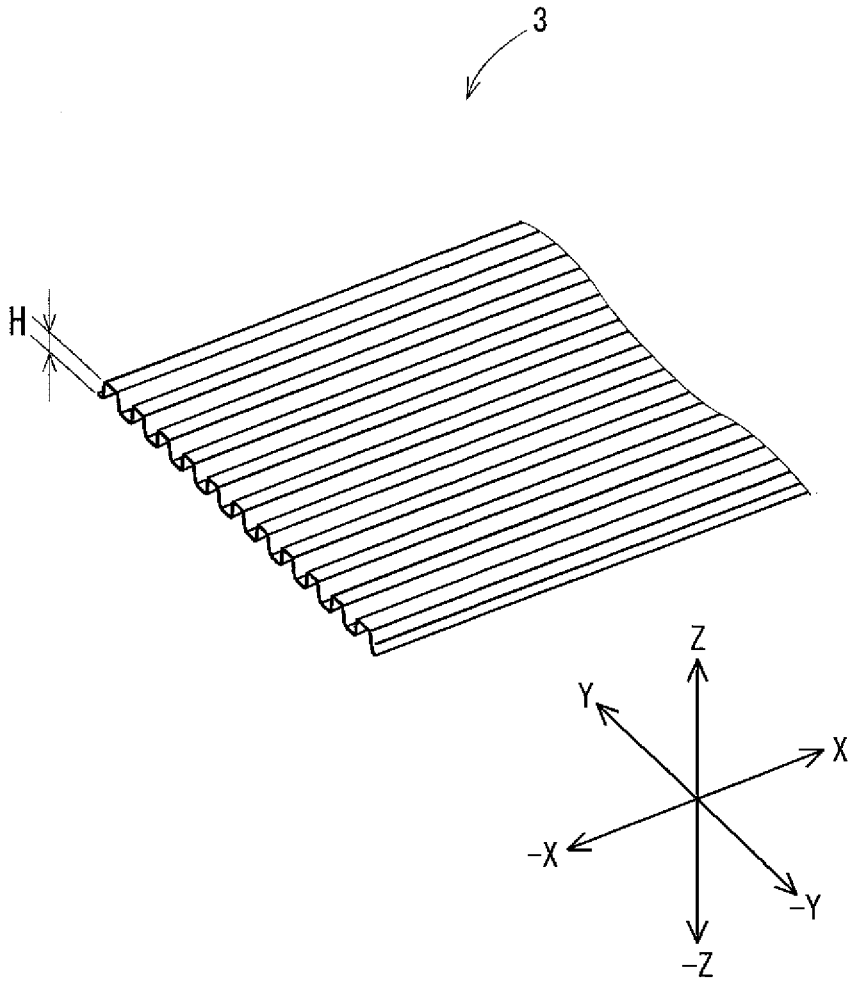
FIG. 7 is a perspective view of a workpiece having been processed by the processing machine according to the first embodiment of the invention.

FIG. 7 shows the workpiece 3 formed by the above described bending method. The workpiece 3 has such a shape that the distance (height) H between the crest of a bump and the valley of an adjacent dent is constant throughout its entire length. That is, the workpiece 3 whose shape is processed by the processing machine 1 has a high accuracy in its height.

The processing machine 1 according to the first embodiment of the invention provides the following advantages.

(1) The processing machine 1 is configured to move the second slide member 40 to cause the second cam device 60 to press the punch 20 against the workpiece 3 after moving the first slide member 30 to cause the first cam device 50 to move the punch 20 to deform the workpiece 3. Since the pressure angle θ2 of the second cam device 60 is smaller than the pressure angle θ1 of the first cam device 50, the load which the punch 20 applies to the workpiece 3 by the action of the second cam device 60 is larger than the load which the punch 20 applies to the workpiece 3 by the action of the first cam device 50. Accordingly, the processing machine 1 can perform the surface pressing step to fix the shape of the workpiece 3 by actuating the second cam device 60 after performing the bending step on the workpiece 3. Therefore, the processing machine 1 can form the shape of the workpiece 3 with high accuracy.

(2) The first cam device 50 is disposed between the punch 20 and the first slide member 30, and the second cam device 60 is disposed between the first slide member 30 and the second slide member 40. The slide columns 70 and 71 are configured to move the second slide member 40 after moving the first slide member 30. Accordingly, the punch 20, the first cam device 50 and the second cam device 60 align in the direction in which the punch 20 moves. Therefore, since the first cam device 50 and the second cam device 60 actuate the same punch 20, it is possible to perform the bending step and the surface pressing step in succession. This makes it possible to downsize the processing machine 1. The first slide member side cam 52 of the first cam device 50 and the punch side cam 53 are in face contact with each other. The first slide member side cam 52 of the first cam device 50 and the punch side cam 53 are in face contact with each other. Accordingly, since the contact pressures applied to the respective cams during the bending step can be made small, the cams can be prevented from seizing.

(3) The slide columns 70 and 71 include the third cam device 74 capable of moving the first slide member 30 and the fourth cam device 75 capable of moving the second slide member 40. The fourth cam device 75 can move the second slide member 40 after the third cam device 74 moves the first slide member 30. Accordingly, by providing the slide columns 70 and 71 with the third and fourth cam devices 74 and 75 having the plurality of the inclined surfaces corresponding to the plurality of the punches 20, the slide columns 70 and 71 can drive the plurality of the first and second slide members 30 and 40 as thick as approximately 2 mm, and the punches 20.

(4) The gap gamma is formed between the first slide member 30 and each hanger member 32 when the first slide member 30 and the first restriction member 33 abut against each other. The gap gamma is necessary for the first slide member 30 to move to the die side by the action of the second cam device 60. Accordingly, the second cam device 60 can press the first slide member 30, the first cam device 50 and the punches 20 to the die side while the first and second restriction members 33 and 34 restrict the movement of the hanger members 32 to the die side and the opposite die side.

(5) Each of the gap between the hanger member 32 and the first restriction member 33 and the gap between the hanger member 32 and the second restriction member 34 is sufficiently small to enable the hanger member 32 to move in the X direction and the −X direction in which the first slide member 30 moves, and to enable suppressing the hanger member 32 from inclining. Accordingly, it is possible to suppress not only the hanger member 32 but also the first slide member 30 from inclining.

(6) The upper roller 44 is disposed between the second slide member 40 and the fixing member 43, and the lower roller 45 is disposed between the second slide member side cam 62 of the second cam device 60 and the pressing member side cam 63. This makes it possible to reduce the frictional force occurring when the second slide member 40 moves. Accordingly, the load which the second cam device 60 applies to the fourth cam device 75 of the right side slight column 70 through the second slide member 40 can be reduced.

(7) The bending method described above includes the bending step for deforming the workpiece 3, and the surface pressing step in which the punch 20 is pressed against the workpiece 3 at a load larger than the load applied to the workpiece 3 in the bending step. Since the workpiece 3 is deformed by the bending step and thereafter its shape is fixed by the surface pressing step, the workpiece 3 can be shaped with high accuracy.

Second Embodiment

Figure 8:
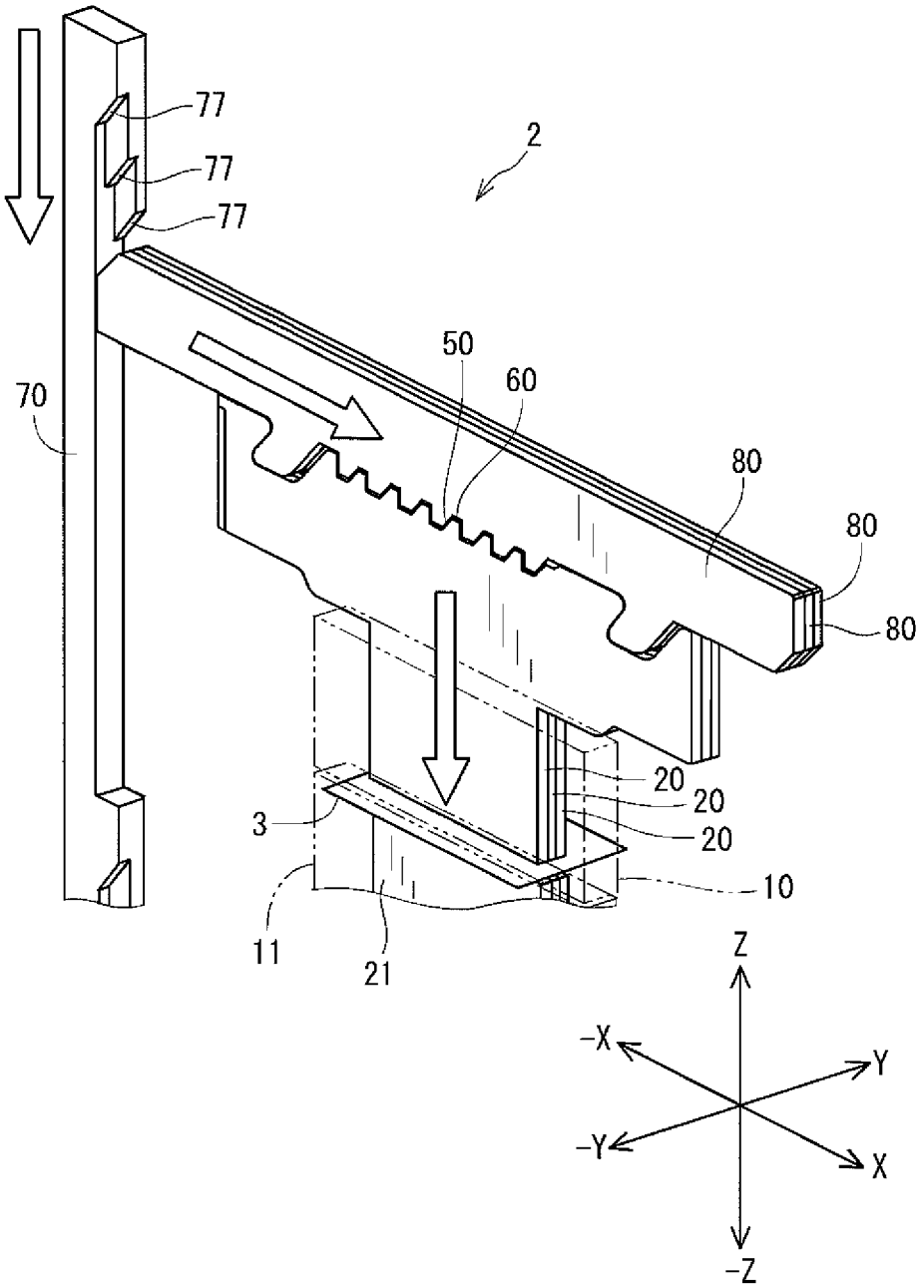
FIG. 8 is a diagram showing the structure of a processing machine according to a second embodiment of the invention.

Next, a processing machine 2 according to a second embodiment of the invention is described with reference to FIGS. 8 to 10. The members, parts or portions of the second embodiment which are the same as or equivalent to those of the first embodiment are indicated by the same reference numerals or characters. In the second embodiment, the die 10, the punches 20, slide members 80 and the first and second cam devices 50 and 60 are disposed upward of the workpiece 3 on the side of the Z direction, while on the other hand, the die 11, the punches 21, the slide members 80 and the first and second cam devices 50 and 60 are disposed downward of the workpiece 3 on the side of the −Z direction. The processing machine 2 includes the two slide columns 70 disposed respectively on the right and left end sides of the slide members 80. In FIG. 8, the slide members disposed downward of the workpiece 3, the first and second cam devices disposed downward of the workpiece 3 and the slide column disposed on the right end side of the slide members are omitted from illustration. Further, in FIG. 8, only three sets of the punches 20 and 21 and the slide members 80 are shown, and the other sets of them arranged in the −Y direction are omitted from illustration. Since the processing components disposed upward of the workpiece 3 are substantially the same as the processing components disposed downward of the workpiece 3, only the processing components disposed upward of the workpiece 3 are explained below.

As shown in FIG. 8, the slide members 80 are disposed upward of the punch 20 and supported by the slide columns 70 at both ends thereof. The slide members 80 are restricted from moving to the die side and to the opposite die side by the first and second restriction members (not shown). Accordingly, the slide members 80 can move in the X direction and in the −X direction.

Figure 9:
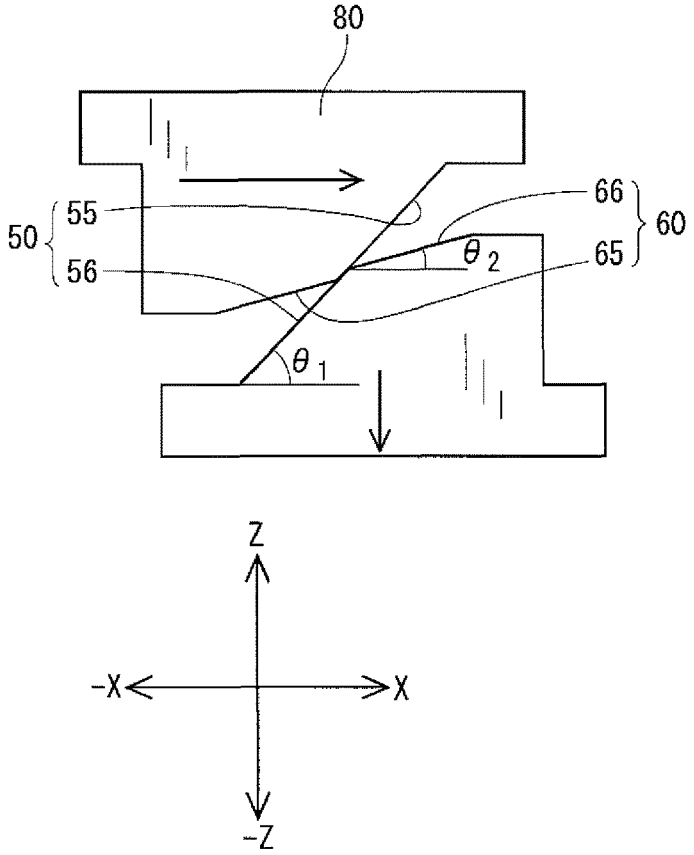
FIG. 9 is a diagram for explaining the operation of cam devices of the processing machine according to the second embodiment of the invention.

As shown in FIG. 9, in the second embodiment, the first and second cam devices 50 and 60 are arranged side by side between each slide member 80 and each punch 20 in the direction in which the slide member 80 moves. The first cam device 50 is formed of slide member side first cams 55 and punch side first cams 56. The first cam device 50 whose pressure angle θ1 is 45 degrees, for example, can deform the workpiece 3 by moving the slide members 80 to thereby move the punch 20 to the die side. The second cam device 60 is formed of slide member side second cams 65 and punch side second cams 66. The second cam device 60 whose pressure angle θ2 is 2 degrees, for example, can press the surface of the workpiece 3 by moving the slide members 80. The pressure angle θ2 of the second cam device 60 is smaller than the pressure angle θ1 of the first cam device 50. The slide member side first cam 55 and the slide member side second cam 65 are disposed continuously in the X direction. The punch side first cam 56 and the punch side second cam 66 are disposed continuously in the X direction.

The slide columns 70 include cam devices 77 for moving the slide members 80 in the X direction and in the −X direction. The cam devices 77 each of which is formed of an inclined surface inclined in the X direction can move the slide members 80 arranged in the −Y direction one by one. When the left side and right side columns 70 move in the −Z direction at the same time, the slide members 80 move in the X direction by the action of the cam devices 77 of the slide columns 70. As a result, the punches 20 move by the action of the first cam device 50 to deform the workpiece 3. Subsequently, the punches 20 presses the surface of the workpiece 3 to plastic-deform the workpiece 3. Accordingly, the workpiece 3 can be shaped with high accuracy.

Figure 10:
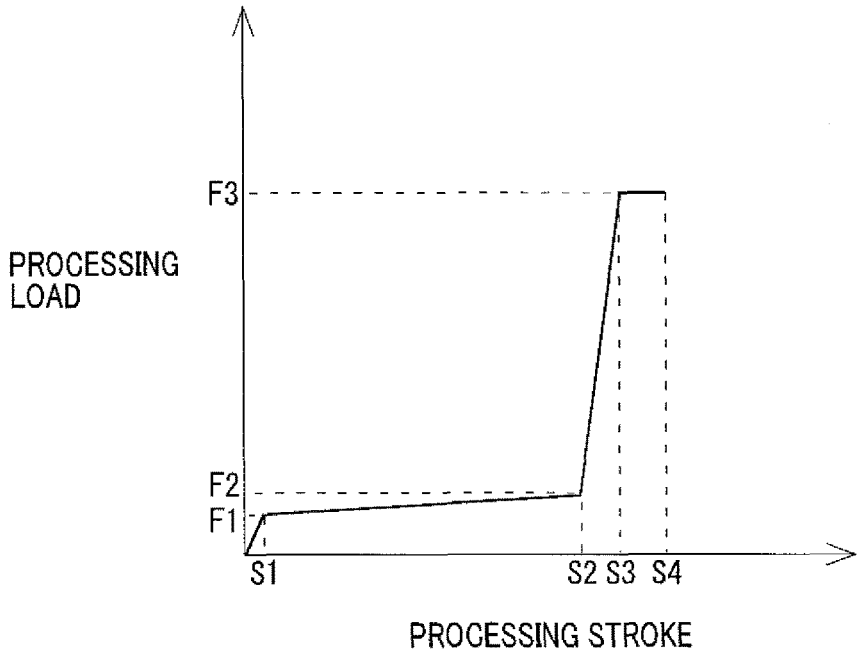
FIG. 10 is a diagram explaining the processing load of the processing machine according to the second embodiment of the invention.

FIG. 10 is a diagram showing a relationship between the processing load applied to the workpiece 3 by the punch 20 and the processing stroke when the slide member 80 is moved in the X direction. When the processing stroke is between S1 and S2, the processing load is in the range from F1 to F2. The bending process is performed using the first cam device 50 while the processing stroke is between S1 and S2. As the processing stroke increases from S2 to S3, the processing load increases abruptly from F2 to F3. The period in which the processing stroke increases from S2 to S3 is the period in which switching between the first cam device 50 and the second cam device 60 is carried out. The processing load is equal to F3 after the processing stroke reaches S3. The surface pressing process is using the second cam device 60 after the processing stroke reaches S3.

In the second embodiment, the first cam device 50 and the second cam device 60 are arrange side by side in the X direction in which the slide members 80 move. Accordingly, the structure of the processing machine 2 of the second embodiment is simple compared to the processing machine 1 of the first embodiment.

Third Embodiment

Figure 11:
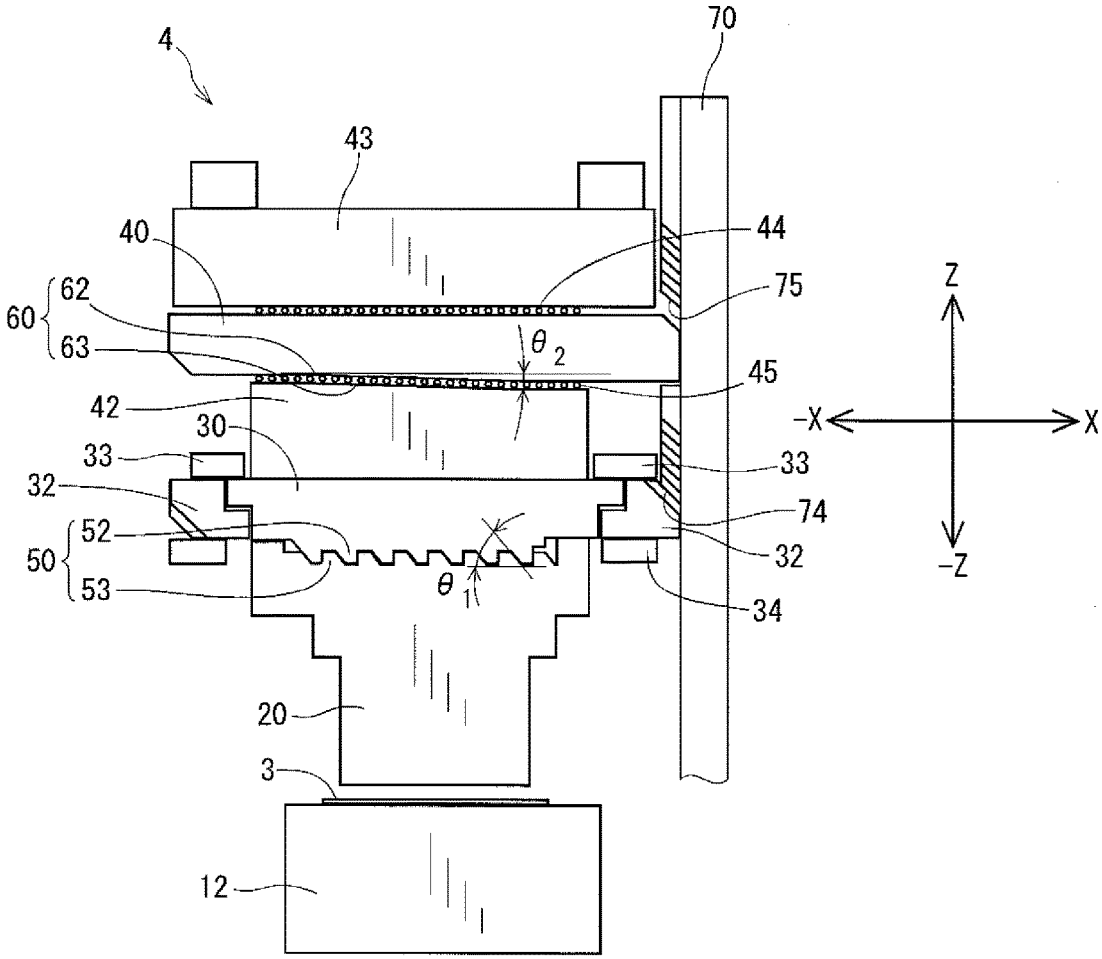
FIG. 11 is a diagram showing the structure of a processing machine according to a third embodiment of the invention.

Next, a processing machine 4 according to a third embodiment of the invention is described with reference to FIG. 11.

In the processing machine 4, the processing components including the punch 20, the first cam device 50, the first slide member 30, the second cam device 60 and the second slide member 40 are disposed only on the side upward of the workpiece 3. The processing machine 4 includes the two slide columns 70 for driving the first and second slide member 30 and 40. The punch 20 is used for pressing workpiece 3 against the die 12 disposed downward of the workpiece 3 to perform the bending process and the surface pressing process. In FIG. 11, the left side slide column is omitted from illustration. According to the third embodiment, the workpiece 3 can be formed in a desired shape using only the structure disposed upward of the workpiece 3.

Other Embodiments (1) In the first embodiment, the second slide member is disposed on the opposite punch side of the first slide member. However, the second slide member may be disposed on the punch side of the first slide member. In this case, the first cam device is disposed between the first slide member and the second slide member, and the second cam device is disposed between the second slide member and the punch. The slide columns move the second slide member after moving the first slide member. Also in this case, the same advantages as those provided by the first embodiment can be provided.

(2) In the first embodiment, the first and second slide members are moved by the slide columns as a driving member. In the second embodiment, the slide members are moved by the slide columns as a driving member. However, a cylinder may be used as such a driving member.

(3) In the third embodiment, the processing components for bending and pressing the workpiece 3 are disposed only on the upward side of the workpiece 3. However, the processing components may be disposed only on the downward side of the workpiece 3.

The above explained preferred embodiments are exemplary of the invention of the present application which is described solely by the claims appended below. It should be understood that modifications of the preferred embodiments may be made as would occur to one of skill in the art.

What is claimed is:

1. A bending method for performing a bending operation on a workpiece using a processing machine, the processing machine comprising:

a die on which the workpiece is placed;

a punch movable in a first direction for pressing the workpiece against the die;

a slide member comprising a first slide member and a second slide member both being movable in a second direction perpendicular to the first direction;

a first cam device that moves the punch toward the die for deforming the workpiece when being actuated by movement of the first slide member;

a second cam device that moves the punch for pressing a surface of the workpiece when being actuated by movement of the second slide member, a pressure angle of the second cam device being smaller than a pressure angle of the first cam device; and a drive member configured to move the first and second slide members such that the second cam device is actuated after the first cam device is actuated, the method comprising:

a positioning process of positioning the workpiece on the die;

a bending process of deforming the workpiece by moving the first slide member using the drive member to actuate the first cam device to cause the punch to move in the first direction to press the workpiece at a first load, the first slide member moving in the second direction and abutting against restriction members disposed on opposing sides of the first slide member, the restriction members being restricted from moving in the first direction; and a surface pressing process of pressing a surface of the deformed workpiece by moving the second slide member using the drive member to actuate the second cam device to cause the punch to move in the first direction to press the surface of the workpiece at a second load larger than the first load.

* * * * *